US005294902A

United States Patent [19]

Pannenborg et al.

[11] Patent Number: 5,294,902

[45] Date of Patent: Mar. 15, 1994

[54] FAIL-SAFE RESIDENTIAL CIRCUIT BREAKER

[75] Inventors: Erich J. Pannenborg; Joseph M. Palmieri, both of Southington; Raymond K. Seymour, Plainville, all of Conn.

[73] Assignee: General Electric Company, New York, N.Y.

[21] Appl. No.: 75,439

[22] Filed: Jun. 14, 1993

[51] Int. Cl.[5] ..... H01H 75/12; H01H 71/16

[52] U.S. Cl. ..... 335/35; 335/43; 337/3; 337/4; 337/70

[58] Field of Search ..... 335/35, 23, 43; 337/70, 337/71, 72, 73, 74, 75, 76, 3, 4, 5, 6, 7, 12, 13, 373

[56] References Cited

U.S. PATENT DOCUMENTS 3,796,930 3/1974 Ellsworth ..... 337/6

4,513,268 4/1985 Seymour et al. ..... 335/35

*Primary Examiner*—Harold Broome

*Attorney, Agent, or Firm*—Richard A. Menelly

[57] ABSTRACT

A molded case circuit breaker for residential use employs an additional safety feature to ensure a fail-safe condition in the event that the circuit breaker is installed within a circuit that may be subjected to an excessive over-current fault that disables the circuit breaker trip unit. The integral bimetal-fuse within the circuit breaker trip unit responds to interrupt circuit current before any damage can occur to the associated electrical wiring system.

7 Claims, 3 Drawing Sheets

FAIL-SAFE RESIDENTIAL CIRCUIT BREAKER

BACKGROUND OF THE INVENTION

U.S. Pat. No. 4,513,268 describes a residential circuit breaker employing a thermal-magnetic trip unit to interrupt circuit current upon the occurrence of an overcurrent condition. When an attempt is made to employ one such circuit breaker in a circuit in excess of the circuit breaker interruption capacity, the bimetal within the trip unit could become inoperably distorted and the circuit breaker contacts could become welded-together due to the intense heat and arcing generated during excessive short circuit overcurrent conditions.

U.S. Pat. No. 3,796,980 describes the inclusion of a separate fusible link between the circuit breaker flexible conductor and the bimetal to destroy the circuit breaker in the event that the bimetal becomes inoperative.

U.S. patent application Ser. No. 912,393 entitled "Thermal-Magnetic Trip Unit with Low Current Response" describes the advanced state-of-the-art of residential circuit breaker trip unit designs.

One purpose of the invention is to provide a fail-safe circuit breaker having low current response to insure that the circuit breaker trip unit responds to interrupt an associate electric circuit in the event that the trip unit bimetal becomes inoperative or the circuit breaker contacts become welded together in their closed condition.

SUMMARY OF THE INVENTION

The invention comprises a molded case circuit breaker having a thermal-magnetic trip unit that includes a combined bimetal-fuse calibrated to electrically interrupt an associated electric circuit in the event that the circuit breaker contacts are unable to separate or the trip unit bimetal becomes damaged per se.

DESCRIPTION OF THE PREFERRED EMBODIMENT

Figure 1:
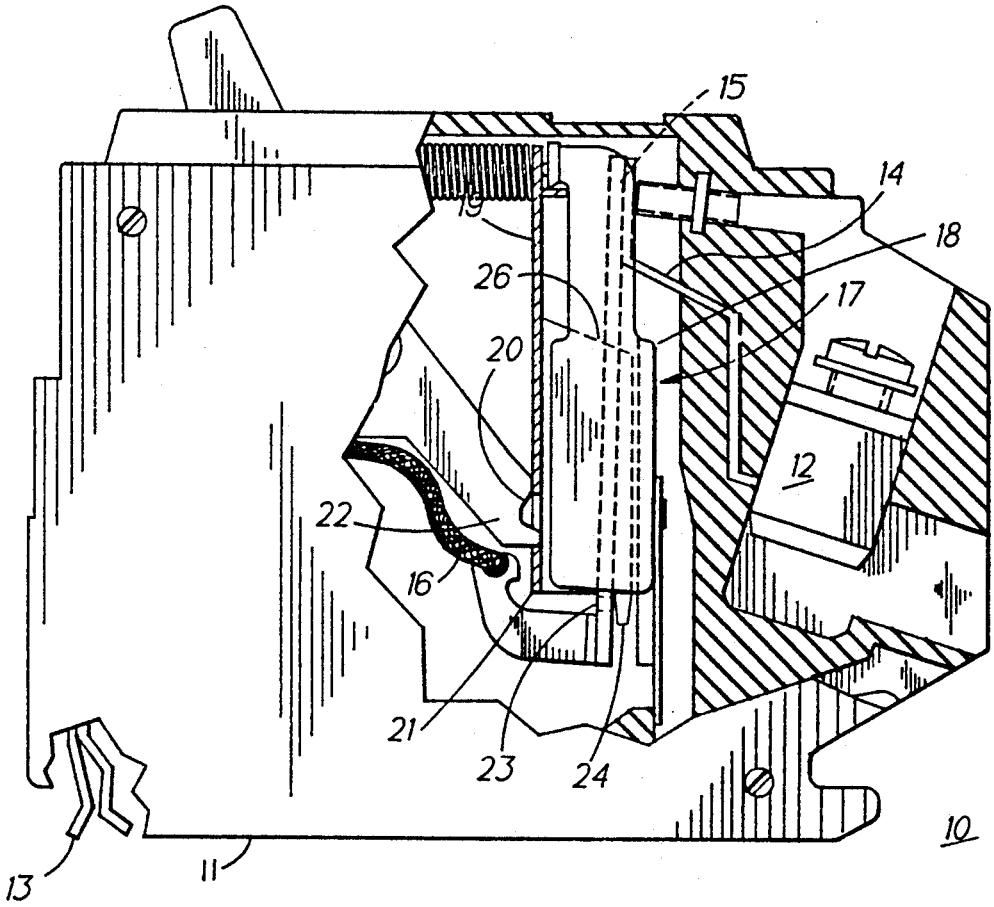
FIG. 1 is a side view of a molded case circuit breaker with a part of the case removed to depict the fail safe trip unit according to the invention.

The fail safe circuit breaker 10 of the invention is shown in FIG. 1 and consists of a molded plastic case 11 to which electrical connection is made by means of a load terminal 12 at the load end thereof and a line terminal 13 at the line end. The current path proceeds from the load terminal 12 through the load strap 14 and the bimetal-fuse 15 within the thermal-magnetic trip unit 17. The operation of the trip unit to interrupt circuit current is more fully described in the aforementioned U.S. patent application Ser. No. 921,393. The current transfers through a flexible braid conductor 16 to the movable contact arm (not shown). The current path remains uninterrupted as long as the hook 21 on the end of the operating cradle 22 remains engaged within the opening 20 provided within the armature-latch 19. Upon displacement of the hook from the opening, the circuit breaker operating mechanism responds to separate the circuit breaker contacts in the manner described within the aforementioned U.S. patent application. An overcurrent is sensed magnetically by response to the magnetic field generated within the magnet 18 partially encompassing the current-carrying bimetal-fuse 15. Short circuit overcurrent conditions rapidly drive the armature-latch 19 towards the magnet 18 resulting in the displacement of the hook 21 out from the opening 20 to articulate the circuit breaker operating mechanism. The overcurrent condition is sensed thermally by displacement of the bimetal-fuse 15 toward the load end of the circuit breaker. A tab 23 formed on the bimetal-fuse 15 abuts an extension 24 on the bottom of the armature sidearm 26 dragging the armature-latch toward the load end of the circuit breaker and thereby displacing the hook 21 out from the opening 20 to articulate the circuit breaker operating mechanism. In the event that the circuit breaker contacts fail to separate, or that the bimetal-fuse 19 becomes distorted, the bimetal-fuse overheats, melts and breaks electrical connection between the load strap 14 and the braid conductor 16 to interrupt circuit current.

Figure 2:
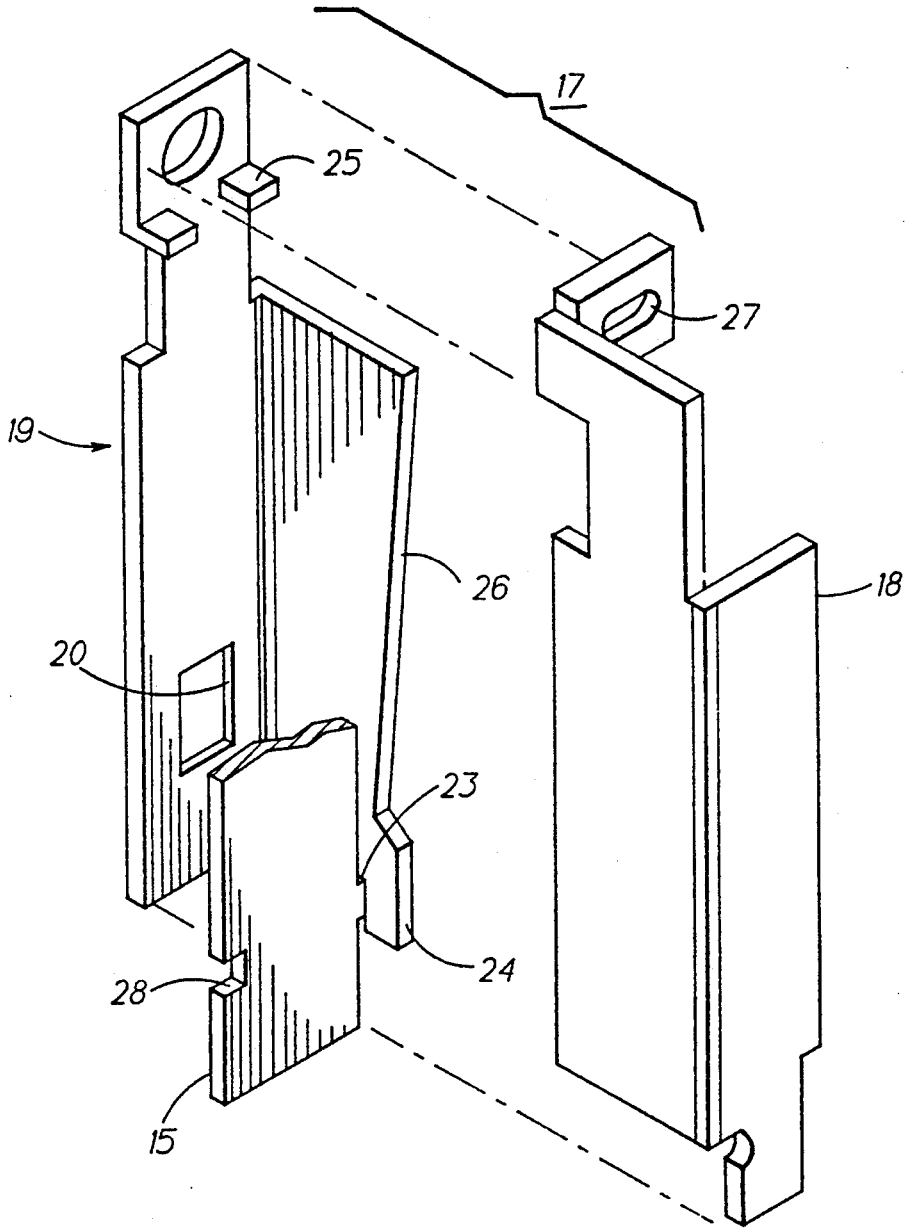
FIG. 2 is an enlarged top perspective view of the trip unit within the circuit breaker of FIG. 1.

The thermal-magnetic trip unit 17 shown in FIG. 2 contains the armature latch 19 formed from a plate of magnetic material and is shaped to form the armature sidearm 26 which includes the extension 24 shown earlier in FIG. 1 as well as the opening 20. The top tabs 25 support the offset end 27 of the magnet 18. In accordance with the teachings of the invention, the bimetal-fuse 15 is shaped to provide the slot 28 on one edge and the tab 23 on the opposite edge for interacting with the extension 24 to motivate the armature-latch 19, as described earlier. The slot 28 formed by an edge-stamping operation reduces the effective current-carrying dimension of the bimetal-fuse without affecting the mechanical strength. Since the current carrying dimension is reduced immediately inboard the slot, the current density is substantially increased resulting in localized heating of the bimetal-fuse in the vicinity of the slot. Upon transport of severe overcurrent conditions, in excess of the capability of the trip unit to respond for the reasons given earlier, the temperature in the vicinity of the slot exceeds the melting temperature of the bimetal-fuse material and melts to interrupt the overcurrent in a safe manner to thereby prevent damage to the exterior wire conductors and the associated electrical equipment.

Figure 3A:
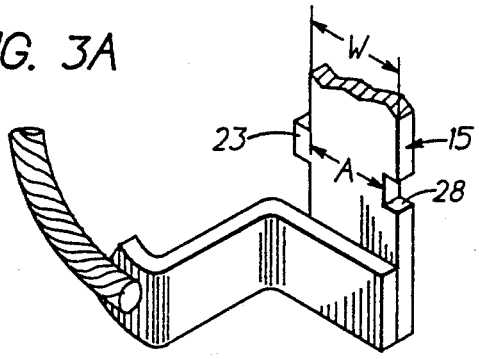
FIGS. 3A–3D are enlarged cutaway front perspective views of alternate embodiments of the bimetal-fuse according to the invention.
Figure 3B:
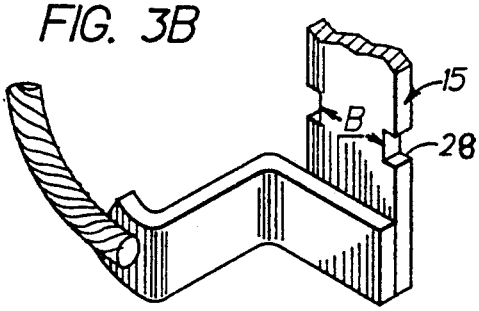
Figure 3C:
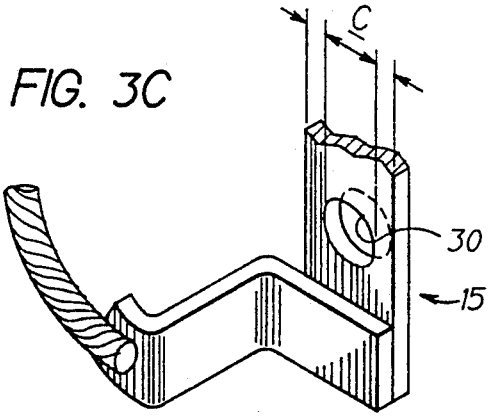
Figure 3D:
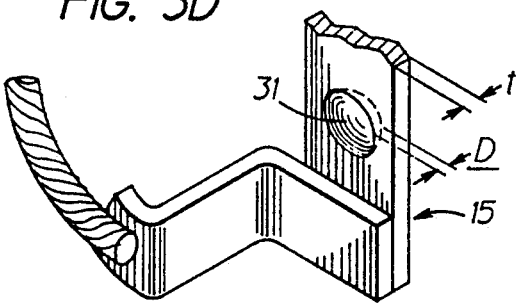
Figure 3E:
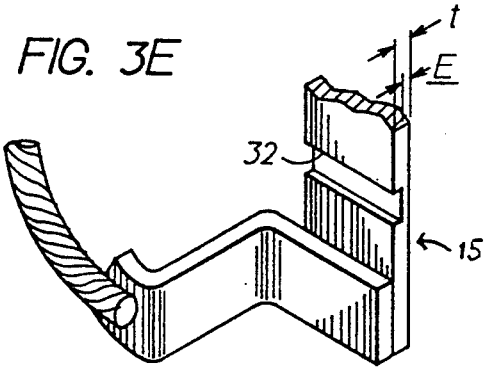

It has been determined that various means of decreasing the current-carrying dimension to a bimetal-fuse can be employed without a substantial change to the thermal-magnetic trip unit and without incurring increased manufacturing cost. FIG. 3A depicts the bimetal-fuse 15 used within the thermal-magnetic trip unit 17 of FIGS. 1 and 2 wherein the bimetal-fuse is blanked to form the slot 28 on one edge and the tab 23 on the opposite end. The dimension of reduced current capacity is depicted at A which can be controlled by the depth of the slot 28 to an exact degree. The width of the remainder of the bimetal-fuse is indicated at W for comparison. A similar reduction in the width of the bimetal-fuse 15 is depicted in FIG. 3B. Both edges thereof are blanked to result in a dimension of reduced current capacity B. The width of the bimetal-fuse 15 is reduced in FIG. 3C by means of the thru-hole 30 the size of which sets the dimension of reduced width C on opposite sides thereof. The bimetal-fuse 15 depicted in FIG. 3D provides a dimension D of reduced current-carrying capacity by coining the bimetal-fuse to result in a reduced thickness as compared to the ordinary thickness t of the bimetal-fuse. The bimetal-fuse 15 of FIG. 3E is provided a dimension E of reduced current-carrying capacity by means of the groove 32 formed across the width thereof. The thickness of the groove is smaller than the thickness t of the bimetal-fuse shown in FIG. 3D.

Tests have indicated that the problems associated with a distorted or otherwise damaged bimetal and welded circuit breaker contacts can be effectively avoided by the fail-safe bimetal-fuse of the invention. The increased current density through the reduced current carrying region effectively melts the bimetal and interrupts the current therethrough.

Having thus described our invention, what we claim by letters patent is:

1. A molded case circuit breaker having a fail safe thermal-magnetic trip unit comprising:

a molded plastic case attached to a molded plastic cover;

an operating mechanism arranged within said case for interrupting current through a protected circuit upon the occurrence of an overcurrent condition;

a pivotally-mounted operating cradle interacting with said operating mechanism by means of a shaped end;

a magnetically-responsive armature latch having an opening receiving said shaped end and retaining said operating mechanism from interrupting current under quiescent current conditions;

a thermal-magnetic trip unit within said case arranged for articulating said operating mechanism by moving said cradle away from said latch opening upon occurrence of an overcurrent condition within a range of predetermined values; and a combined bimetal-fuse element within said trip unit, said element having a reduced dimension to provide a region of increased current density whereby said element melts to interrupt current when said overcurrent condition exceeds a range of predetermined values.

2. The molded case circuit breaker of claim 1 wherein said element comprises a thermal-responsive plate of a defined length, thickness and width, said width being reduced in one region to provide said region of increased current density.

3. The molded case circuit breaker of claim 1 wherein said element comprises a thermal-responsive plate of a defined length, thickness and width, said thickness being reduced in one region to provide said region of increased current density.

4. The molded case circuit breaker of claim 1 wherein said element comprises a thermal-responsive plate having a slot on one edge thereof to provide said region of increased current density proximate said slot.

5. The molded case circuit breaker of claim 1 wherein said element comprises a thermal-responsive plate having a thru-hole formed therein to provide said region of increased current density proximate said thru-hole.

6. The molded case circuit breaker of claim 1 wherein said element comprises a thermal-responsive plate having a depression formed on one surface to provide said region of increased current density within said depression.

7. The molded case circuit breaker of claim 1 wherein said element comprises a thermal-responsive plate having a groove formed therein extending across said plate to thereby provide said region of increased current density.

* * * * *